United States Patent [19]

Schaller et al.

[11] Patent Number: 4,580,481

[45] Date of Patent: Apr. 8, 1986

[54] MAGNETIC PICKUP FOR STRINGED INSTRUMENTS

[76] Inventors: Helmut Schaller, Kuckucksweg 16, 8501 Feucht, Fed. Rep. of Germany; Jan C. Mol, Duinwÿckweg 5, 2061 AB Bloemendaal NL, Netherlands

[21] Appl. No.: 572,586

[22] Filed: Jan. 20, 1984

[51] Int. Cl.[4] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 3,541,219 | 11/1970 | Abair | 84/1.15 |
| 3,715,446 | 2/1973 | Kosinski | 84/1.15 |
| 4,069,732 | 1/1978 | Moskowitz et al. | 84/1.16 |
| 4,075,921 | 2/1978 | Heet | 84/1.16 |
| 4,261,240 | 4/1981 | Aaroe | 84/1.15 |
| 4,501,185 | 2/1985 | Blucher | 84/1.15 |
| 4,535,668 | 8/1985 | Schaller | 84/1.15 |

*Primary Examiner*—S. J. Witkowski

*Attorney, Agent, or Firm*—McCormick, Paulding & Huber

[57] ABSTRACT

In a magnetic pickup for stringed musical instruments at least one coil is associated with each string and at least one magnet produces a magnetic field passing through the coil which is varied by the vibration of the string to induce a signal in the coil, the magnet being movable relative to the coil in such a manner that both the strength and the phase of the induced signal may be varied.

6 Claims, 11 Drawing Figures

MAGNETIC PICKUP FOR STRINGED INSTRUMENTS

The invention intends to provide a magnetic pickup for stringed instruments, such as guitars, having electric amplification, in the case of which a string vibrates in a changeable magnetic field in such a way that an electric signal will be induced in a coil situated near the string, which signal can be varied in strength and can be shifted in phase by changing the magnetic field.

Known magnetic pickups consist of a coil and a magnet in a mutually fixed position. Such a unit is placed in a fixed position under the strings and therefore the signal induced by a vibrating string cannot be influenced in strength nor in phase. The pickup according to the invention, however, allows this fully and therefore offers a great number of new sound possibilities. Accordingly, for instance, under the six strings of a guitar a coil can be placed which is provided with two magnets which can be individually changed in position and the magnetic field of each magnet is restricted to a group of only three strings. Changing the position of a magnet will only affect the signal of one group of strings in volume or phase, so that for instance the sound volumes of the two groups of strings can be brought into any desired balance. By placing two of these pickups under the strings, the output signals of both systems can be brought fully or partly out of phase with each other, allowing many remarkable sound effects. Naturally it is possible to continuously change the position of the magnets by means of a mechanical device which also allows many new sound effects. The pickup according to the invention therefore offers a great number of new and unprecedented possibilities, as will be explained hereinafter.

According to a first design of the invention, an oblong coil is placed, for example, under the six strings of a guitar and is provided with an iron core. Underneath the coil there are two magnets which are placed parallel to the long side of the coil and have half the width of the width of the coil, so that each magnet can be moved from one side of the coil to the other side.

If a magnet is moved to one side of the coil, that side is thus situated in the magnetic field. A vibrating string, which is also situated in this magnetic field, will induce an electric signal in the concerned side of the coil. Since the direction of the windings of one side of the coil is reversed in relation to the other side, the signal induced by a vibrating string will be contrary in phase to the signal which, after moving the magnet to the other side, will be induced in that side of the coil. If the magnet is placed exactly in the middle underneath the coil, a signal will be induced in one side of the coil which is in counterphase with the signal which, at the same time, will be induced in the other side. Both signals will thus eliminate each other and the resulting sound reproduction is reduced to zero. Moving a magnet underneath the coil from one side to the other, therefore results in full signal strength in the starting position, which gradually diminishes to zero in the middle position, and thereafter increases again to the original level, but now in counterphase with the initial signal. In this way the sound reproduction of a string can be fully controlled in volume and desired phase.

According to a second design the core of an oblong coil is provided with two magnets which can be turned individually around a shaft, which is placed parallel to the long side of the coil. The magnets are magnetized parallel to the length direction of the strings. If the poles are in a plane which is parallel to the plane of the strings, a vibrating string will induce signals in both sides of the coil, which will be in counterphase with each other, so that no sound reproduction will result. If the poles are in a plane perpendicular to the plane of the strings, the resulting signals in both halves of the coil will be in phase, so that maximum signal strength will result. Therefore, if a magnet is rotated 360°, starting from a position in which the poles are in a plane perpendicular to the plane of the strings, the initial signal will be maximum and diminish as the magnet is turned. After a 90° turn the signal strength is reduced to zero and will gradually increase at further turning of the magnet.

After a 180° turn maximum strength is again reached; the phase, however, is contrary to the initial signal. After a 270° turn the resulting signal is again reduced to zero and thereafter increases to the strength and phase of the initial signal. If this pickup is for instance placed under the six strings of a guitar, the strength and phase of the signal of three strings can be controlled independently from the signal of the other three strings.

A third design according to the invention consists of two oblong coils, which are located close to each other. The coils are provided with cores of magnetic material, for example iron, which protrude from underneath the coils. Between these core ends two magnets are placed, which can be rotated independently, for example, around a shaft which is placed parallel to the cores. The turning of a magnet gives the same results as already described in former designs.

According to a fourth design two pickups of a first, second or third design are placed for example under six strings. Thus it is possible that one pickup only represents three strings by placing the magnet for the other strings in zero-position. The second pickup can accordingly represent only these other three strings. If each pickup is connected with a separate input channel of a stereo amplifier, stereo reproduction can be obtained: three strings are audible through one channel and the other three strings through the other channel. Also the magnets can, if desired, be adjusted in such a way that the signal of one pickup is completely or partly in counterphase with the signal of the other pickup. This creates countless sound variations and sound compositions.

According to a fifth design the two magnets of the first, second or third design are replaced by more magnets, so that, for example, a separate magnet per string can be installed.

In illustration of the invention a number of designs will be described with reference to the drawing in which.

Figure 1:
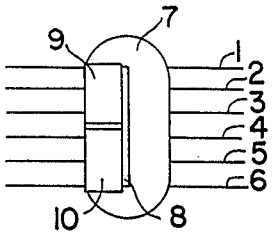
FIG. 1 is a schematic bottom plan view of a first design of the invention.
Figure 2:
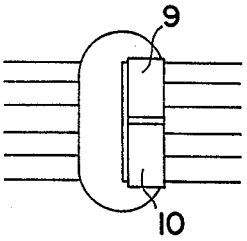
FIG. 2 is a bottom plan view like FIG. 1, but shows another position of the magnets.

In FIGS. 1 and 2 a first design is schematically illustrated. Under the strings 1, 2, 3, 4, 5 and 6 an oblong coil 7 is placed, which is provided with a iron core 8. Underneath against the coil two magnets 9 and 10 are placed, which can be moved individually from one side of the coil to the other side along a not illustrated guiding device. In the illustrated position a vibrating string will induce a signal of maximum strength in the corresponding side of the coil.

FIG. 2 illustrates a position in which the magnets 9 and 10 are located at the other side of the coil; the strength of the induced signal is also maximum, but in counterphase with the signal that results from the position as illustrated in FIG. 1. If the magnets are placed underneath the middle of the coil, the signals induced in both coil sides will be in counterphase and therefore eliminate each other, so that the resulting signal is nil.

Figure 3:
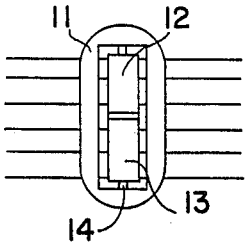
FIG. 3 is a schematic bottom plan view of a second design of the invention.

In FIG. 3 a second design is schematically illustrated. Under six strings an oblong coil 11 is placed, of which the core consists of two magnets 12 and 13, which can be turned individually around a shaft 14. Rotating a magnet gives the results as described in the foregoing.

Figure 4:
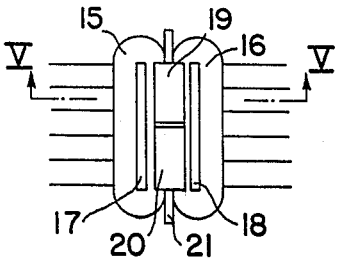
FIG. 4 is a schematic bottom plan view of a third design of the invention.
Figure 5:
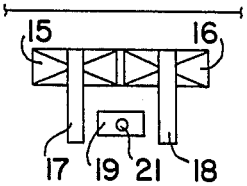
FIG. 5 is a sectional view taken on the arrows V—V of FIG. 4, on a larger scale.

FIGS. 4 and 5 show a third design, wherein two oblong coils 15 and 16 are placed close to each other. Each coil is provided with an iron core 17 and 18, between which two magnets 19 and 20 are placed, which can rotate individually around a shaft 21. In the position of the magnet 19 illustrated in FIG. 5, vibrating string will induce a signal of maximum strength; after a 90° turn of the magnet the signal strength will be nil; and after a 180° turn the signal strength will again be maximum but in counterphase with the initial signal.

Figure 6:
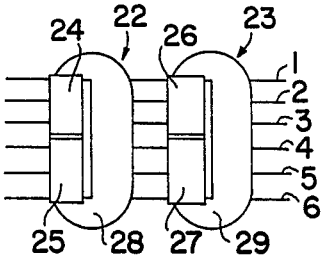
FIG. 6 is a schematic bottom plan view of two pickups according to the first design, placed under six strings.
Figure 7:
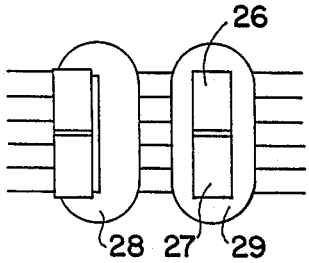
FIG. 7 is a bottom plan view as FIG. 6, but shows another position of the magnets.
Figure 8:
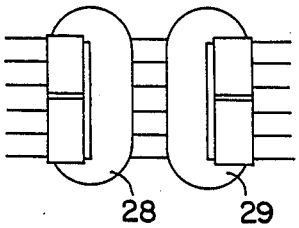
FIG. 8 is a bottom plan view as FIG. 7, but shows another position of the magnets.
Figure 9:
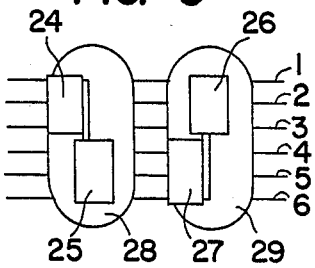
FIG. 9 is a bottom plan view as FIG. 8, but shows another position of the magnets.

FIG. 6 shows a fourth design. As an example, two pickups 22 and 23 as per the first design of the invention, are placed under six strings 1, 2, 3, 4, 5 and 6. The magnets 24, 25, 26 and 27 are all individually adjustable, which allows countless adjustments, of which FIG. 7, 8 and 9 give a few examples. FIG. 6 shows a situation, wherein the magnets 24, 25, 26 and 27 are placed in identical positions. Therefore the vibrating strings will induce signals in the coils 28 and 29, which are of maximum strength and in phase with each other, so that the resulting sound signal consist of the each other reinforcing signals of the coils 28 and 29.

In FIG. 7 coil 28 provides a maximum signal, while coil 29 does not provide any signal because the magnets are placed under the middle of the coil. The resulting sound signal therefore consists only of the signal of coil 28.

In FIG. 8 coil 28 provides a maximum signal. Coil 29 also provides a maximum signal which, however, is in counterphase with the signal of coil 28. As both coils are positioned at different places under the strings and as the sound spectrum of a strings varies from place to place, the resulting sound signal will not be completely reduced to nil, but will produce a high and sharp sound impression.

FIG. 9 shows a position wherein the signal of coil 28 is only representative for the vibrations of strings 1, 2 and 3, because the magnet 25 is placed in the middle underneath this coil. In the same way coil 29 only represents the other group of three strings 4, 5 and 6, because the magnet 26 is placed underneath the middle of the coil. If coil 28 connected with a channel of a stereo amplifier and coil 29 with the other channel fully separated reproduction of the two groups of three strings can be realized. Naturally the magnets 24, 25, 26 and 27 can be placed in countless different positions, which allows countless sound variations.

Figure 10:
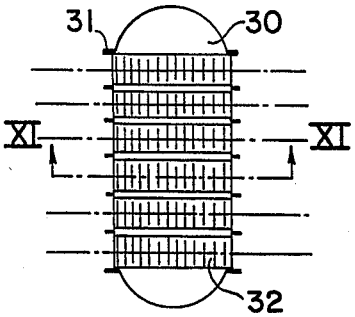
FIG. 10 is a schematic top plan view of a fifth design of the invention.
Figure 11:
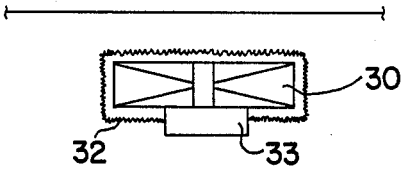
FIG. 11 is a sectional view taken on the arrows XI—XI in FIG. 10.

FIGS. 10 and 11 show a fifth design according to the invention, in which the casing of a coil 30 is provided with guiding posts 31, between which six ribbed ribbons can be shifted, each of which is connected with a separate magnet. In this way six magnets can be moved separately, allowing any desired adjustment per string. FIG. 11 shows a sectional view taken on the arrows XI—XI of FIG. 10; wherein a magnet 33 is placed underneath the middle of coil 30 by the ribbed ribbon 32.

We claim:

1. A magnetic pickup for stringed musical instruments in the case of which at least one string vibrates in a magnetic flux field in such a way that an electric signal is induced in a coil placed near the string, characterized by the pickup having at least one coil situated near a string and provided with at least one magnet which can be changed in position with respect to said coil in such a way that the electric signal induced in said coil by changes in the magnetic flux produced by said magnet and due to the vibration of said string can be varied in strength and shifted in phase, said coil being provided with a core of magnetic material and said magnet being located underneath said coil for movement from one side of said coil to the other side of said coil.

2. A magnetic pickup as defined in claim 1, further characterized in that each string of the instrument is associated with two coils each of which coils is provided with a core of magnetic material and at least magnet located underneath said coil for movement from one side of said coil to the other side of said coil to vary the strength and phase of the signal induced in it by said string.

3. A magnetic pickup as defined in claim 1 further characterized by a plurality of magnets each of which can be changed in position with respect to said coil in such a way that the electric signal induced in said coil by changes in the magnetic flux produced by said magnet and due to vibration of a string can be varied in strength and shifted in phase.

4. A magnetic pickup as defined in claim 1 further characterized by the number of said magnetic being equal to the number of strings of the stringed instrument with which said pickup is to be used.

5. A magnetic pickup for stringed musical instruments in the case of which at least one string vibrates in a magnetic flux field in such a way that an electric signal is induced in a coil placed near the string, characterized by the pickup having at least one coil situated near a string and provided with at least one magnet which can be changed in position with respect to said coil in such a way that the electric signal induced in said coil by changes in the magnetic flux produced by said magnet and due to the vibration of said string can be varied in strength and shifted in phase, said magnet being mounted within said coil for rotation relative to said coil about an axis extending perpendicular to said string.

6. A magnetic pickup for stringed musical instruments in the case of which at least one string vibrates in a magnetic flux field in such a way that an electric signal is induced in a coil placed near the string, characterized by the pickup having at least one coil situated near a string and provided with at least one magnet which can be changed in position with respect to said coil in such a way that the electric signal induced in said coil by changes in the magnetic flux produced by said magnet and due to the vibration of said string can be varied in strength and shifted in phase, said at least one coil being one of two coils situated near a string, each of said two coils having a protruding iron core, and said magnet being mounted between the protruding portions of said two iron cores for rotation about an axis perpendicular to said string.

* * * * *